United States Patent [19]

Harris

[11] Patent Number: 4,908,999

[45] Date of Patent: Mar. 20, 1990

[54] STAGING

[75] Inventor: Benjamin J. Harris, Wendlebury, England

[73] Assignee: B. J. Harris (Oxford) Limited, Osney, England

[21] Appl. No.: 192,915

[22] Filed: May 12, 1988

[30] Foreign Application Priority Data

May 13, 1987 [GB] United Kingdom ..... 8711221
Mar. 26, 1988 [GB] United Kingdom ..... 8807258

[51] Int. Cl.[4] ..... E04H 3/12

[52] U.S. Cl. ..... 52/8; 182/223; 248/354.5; 403/388

[58] Field of Search ..... 52/6–10, 52/637, 648, DIG. 11, 169.1, 169.4, 170, 731; 182/178, 179, 223, 222; 403/388; 248/354.5

[56] References Cited

U.S. PATENT DOCUMENTS

| | | | |
|---|---|---|---|
| 1,839,233 | 1/1932 | Leffert et al. | 52/8 X |
| 1,839,410 | 1/1932 | Post | 52/8 |
| 1,841,676 | 1/1932 | Roberts | 182/223 X |
| 2,575,593 | 11/1951 | Peery | 52/183 X |
| 2,651,081 | 9/1953 | Storer, Jr. | 52/8 |
| 2,952,164 | 9/1960 | Hofgesang | 403/388 X |
| 3,204,910 | 9/1965 | Gacher | 248/354.5 X |
| 3,281,164 | 10/1966 | Reaser | 403/388 X |
| 3,356,330 | 12/1967 | Rambelle | 248/354.5 |
| 3,383,080 | 5/1968 | Frisbie | 248/354.5 |
| 3,537,724 | 11/1970 | Matthews | 248/354.5 X |
| 3,698,149 | 10/1972 | Baker et al. | 52/731 |
| 3,967,083 | 6/1976 | Bould et al. | 403/388 X |
| 4,747,238 | 5/1988 | Wikström et al. | 52/8 |

FOREIGN PATENT DOCUMENTS

| | | | |
|---|---|---|---|
| 220829 | 7/1909 | Fed. Rep. of Germany | 52/8 |
| 695774 | 8/1953 | United Kingdom | 52/6 |
| 879163 | 10/1961 | United Kingdom | 403/388 |
| 2080357A | 2/1982 | United Kingdom | 52/9 |

*Primary Examiner*—Carl D. Friedman
*Assistant Examiner*—Anthony W. Williams
*Attorney, Agent, or Firm*—Fleit, Jacobson, Cohn, Price, Holman & Stern

[57] ABSTRACT

Staging particularly for use in group photography comprises spaced support assemblies 1, 2. Each support assembly comprises a rearwardly inclined truss member 3, 4 supported by a respective pair of legs 5, 6 arranged in an inverted-V configuration. Each truss carries a series of support brackets 14 to which decking members 15 are connected for pivotal movement in vertical and horizontal planes enabling the support assemblies to adopt different attitudes. The feet of the legs 5, 6 and the lower ends of the trusses swivellably stand on ground plates 13. The lower ends of the legs 5, 6 are pivotally coupled to a bracing bar 9 and their upper ends are pivoted together enabling the legs to be adjusted in length for coarse levelling of the support assemblies. A tie rod 11 joins the bracing bar 9 to the lower end of the respective truss 3, 4. The upper ends of the legs are releasably coupled to the respective truss, and extension sections 3a, 4a are provided for connection to the upper ends of the trusses to support further decking members.

41 Claims, 9 Drawing Sheets

STAGING

BACKGROUND OF THE INVENTION

1. Field of the Invention

This invention is concerned with staging of the comprising a plurality of decking members arranged in a stepped configuration for supporting a group of people. The present staging has specifically been developed for use in group photography, although the staging may also be used in other situations where it is necessary to support a standing group of people, e.g. at a show or game. Some aspects of the invention are also applicable to staging for use in audience seating.

2. Description of the Prior Art

Existing staging structures for use in group photography are heavy and bulky to transport and are slow and difficult to erect, particularly on uneven or sloping ground. For example, in one such structure each decking member is supported by two or more timber trestles which must each be individually erected and levelled. In other existing photographic staging the decking members are supported by a scaffolding arrangement comprising numerous bars, clamps and other components which must all be connected together. That structure also has many individually adjustable feet which must all be correctly adjusted to avoid undesirable stresses being produced in the structure. There is also a large timber structure in commercial use which requires a team of erectors and a fleet of about seven lorries to transport it.

Generally speaking, all of the existing photographic staging discussed above has a large number of feet that must all be individually levelled. Apart from being extremely time consuming, failure to perform this task correctly may result in instability of the structure and/or undesirable stresses in the structure, both of which may increase the risk of structural failure when fully loaded.

U.S. Pat. No. 1,839,679 discloses a staging structure for use in audience seating in which the decking members are supported by spaced rearwardly inclined trusses. Each truss is in turn supported by spaced pairs of props or legs arranged in an inverted-V configuration. The lower ends of the legs are joined by common bracing bars running parallel to the decking members, and a single tie bar lying below each truss connects the bracing bars to the bottom of the respective truss. This earlier staging is therefore a relatively rigid form of construction and consequently great care must be taken to ensure that each of the feet is individually levelled.

BRIEF SUMMARY OF THE INVENTION

An important consideration in the design of the present staging has been to provide a form of staging which can be erected quickly and easily by a minimum number of personnel. This consideration applies equally whether the staging has a relatively small number of decking rows, say four or five, or whether the number of rows is increased to around ten or more.

It is very important to appreciate that for staging to be suitable for use in group photography the decking members must be stepped at a relatively steep angle compared with staging for audience seating, where the angle is typically between 20 and 27 degrees. This presents particular problems in erecting the staging, especially if the staging has a large number of rows so that the height of the staging could easily exceed ten feet.

Thus, a form of staging which is suitable for audience seating may not necessarily be suitable for adaptation to photographic staging.

According to a first aspect the present invention provides staging for supporting a standing group of people, comprising a plurality of transversely spaced trusses, support means for supporting the trusses at rearward inclinations of greater than 30 degrees to horizontal, and a plurality of decking members bridging the trusses in a stepped configuration.

The concept of supporting the decking members from common spaced main structural members in the form of inclined trusses has given rise to a design of staging which is simple to erect since the trusses can, for example, be laid in their correct positions on the ground and then raised to the inclined position.

The trusses are preferably inclined at an angle of more than 40 degrees and less than 50 degrees, 45 degrees being the optimum angle within an acceptable tolerance band of 42 to 47 degrees. Below 42 degrees the heads of people will tend to become obscured by the people in front, or the number of rows will be reduced. Above 47 degrees the steepness of the staging has been found to have an alarming psychological effect on the users, and the available space between the rows is reduced.

Preferably a plurality of decking members are connected together in end-to-end relation for relative pivotal movement in a substantially horizontal plane whereby the staging can be curved into an arc. Such an arrangement is particularly useful in group photography enabling all the subjects to be equidistant from the camera.

A second aspect of the invention concerns the problem of arranging the staging to stand firmly on uneven or sloping ground. The proposed solution to this problem is equally applicable to standing and seated group staging.

According to a third aspect the invention provides staging comprising a pair of mutually spaced support assemblies, each support assembly comprising a truss and a pair of legs arranged in an inverted-V configuration to support the truss with a rearward inclination, and a plurality of decking members bridging the trusses in a stepped configuration, the decking members being connected to each truss by a flexible joint whereby the support assemblies are able to adopt mutually different attitudes.

This solution takes advantage of the fact that a tripod structure will always stand firmly on uneven ground. Thus, although some coarse levelling adjustment of each support structure may be desirable, the work of levelling is greatly reduced. This basic structure can be used to provide a lightweight easily erectable staging up to about five rows of decking. Furthermore, as will be explained below, the structure can be extended to provide up to ten or eleven rows whilst still retaining the important features of ease of assembly and stability.

The flexible joints are most importantly arranged to permit pivotal movement of the decking members in a vertical plane although some movement in a horizontal plane is also desirable from the point of view of creating a stable structure. Both planes of movement may be achieved by separate joints although they are preferably provided by one and the same joint.

The decking members are preferably releasably connected to the trusses for ease of erection and dismounting.

The legs and the front ends of the trusses preferably all stand on swivellable ground plates.

Preferably at least one of the rear legs associated with each truss is of adjustable length. Adjustment of one, or preferably both of the rear legs allows rapid coarse levelling of each support structure on uneven ground. Each pair of legs is preferably bridged at their lower end by a brace. Each brace is preferably connected to the front end of the respective truss by a tie element. The legs are preferably pivotally coupled to the bracing bars and the legs of each pair are preferably pivoted together at their upper ends, where they are preferably releasably connected to the respective truss.

In a further aspect the invention is addressed to the possibility of adding further decking members. In the existing staging based on trestles this is a major task requiring the erection of further trestles and decking members. In group photography of between say 100 and 1000 people it is desirable to optimize the height of the group in order to make optimum use of the available space in the final prints, thereby permitting the face size of each individual to be increased. This requirement is also relevant to seated group staging.

According to another aspect the invention provides staging comprising a plurality of transversely spaced trusses, support means for supporting the trusses at rearward inclinations, each truss comprising a plurality of interconnectable sections, and a plurality of decking members bridging the trusses in a stepped configuration, the arrangement being such that all the corresponding sections of the trusses are bridged by at least one decking member.

BRIEF DESCRIPTION OF THE DRAWINGS

In further aspects, which for brevity will not be further specified, the invention includes any novel combination of the features disclosed herein.

Each aspect of the invention is exemplified in the following description to be read in conjunction with the accompanying drawings, wherein.

DETAILED DESCRIPTION

Figure 1:
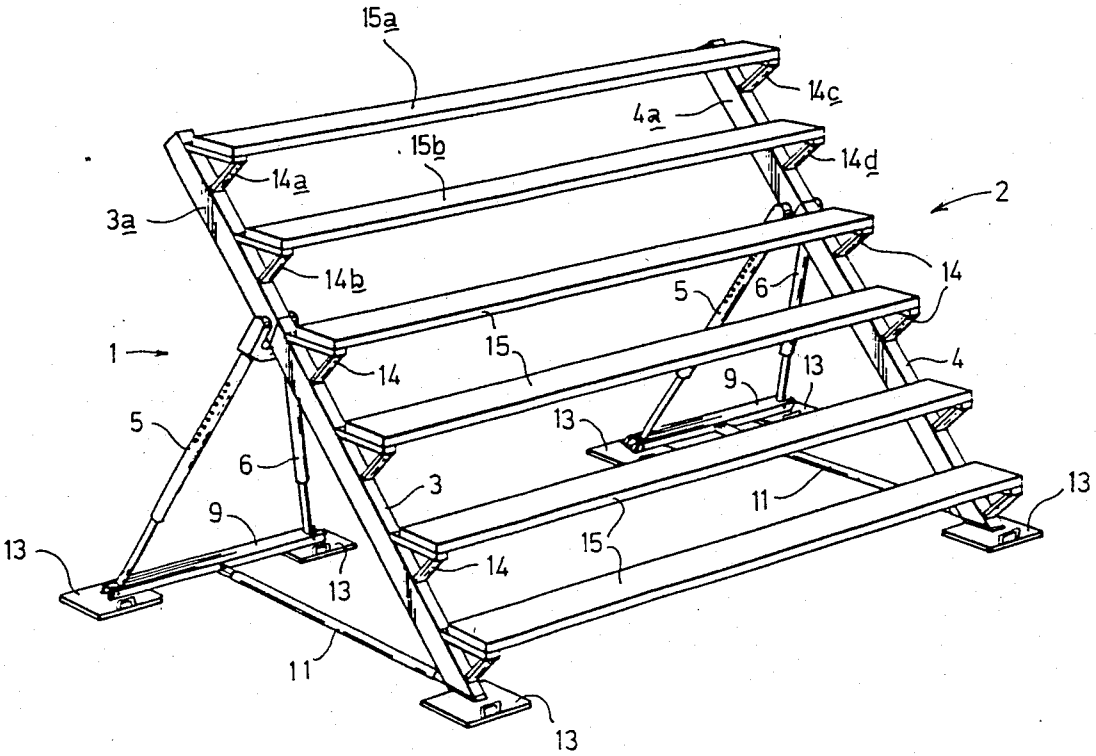
FIG. 1 is a perspective view of a single four deck photographic staging section with an upper two deck extension section added.

The basic four deck staging section shown in FIG. 1 comprises two spaced support assemblies 1, 2. Each assembly includes a box section truss 3, 4 which is rearwardly inclined at an angle of about 45 degrees to horizontal and is supported by two forwardly inclined rear legs 5, 6 arranged in an inverted-V configuration, thereby forming a tripod structure. Each pair of rear legs are joined at their lower ends by a brace 9, and a tie rod 11 connects the lower end of the respective truss 3 or 4 to the mid-region of the respective brace 9. The lower ends of the trusses 3, 4 and rear legs 5, 6 are all seated on ground plates 13 to increase their bearing area and prevent them from sinking into soft ground. The front upper faces of the trusses 3, 4 carry a series of spaced V-shaped brackets 14 for supporting four substantially horizontal decking members 15 which bridge the support assemblies 1, 2.

Figure 2:
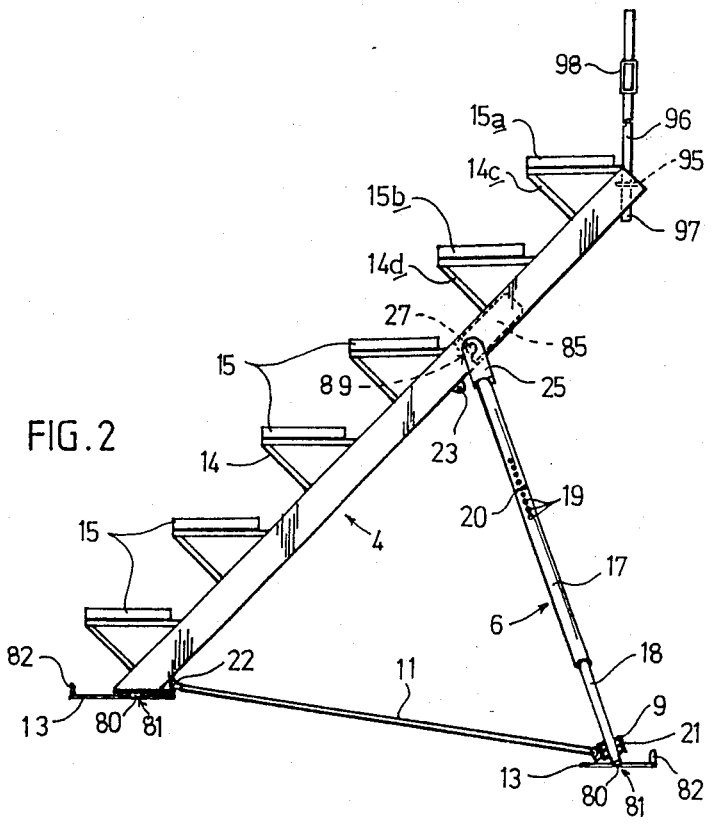
FIGS. 2 and 3 are end and rear views, respectively, of one of the trusses used in the invention together with its supporting leg assembly.
Figure 3:
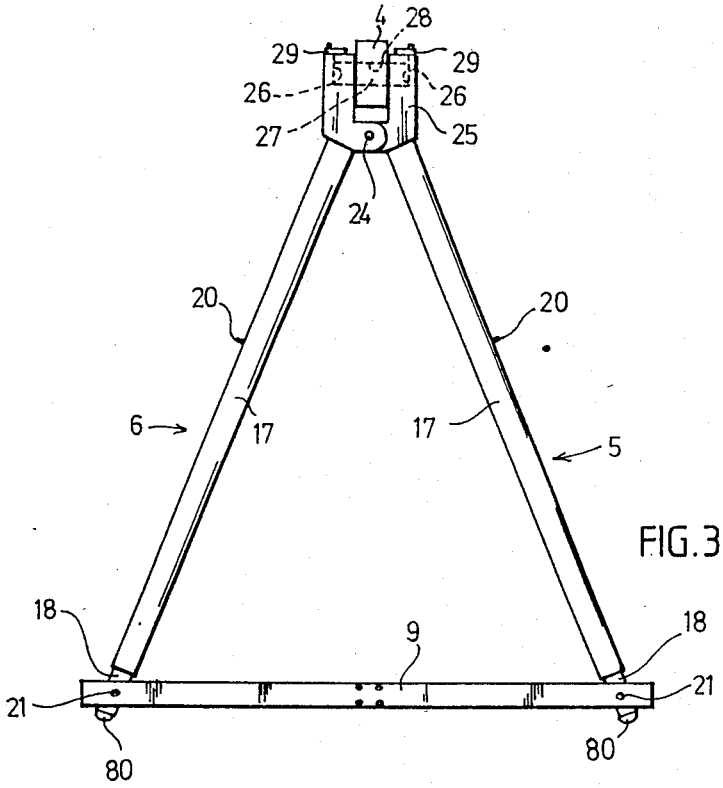

As shown in more detail in FIGS. 2 and 3, each of the rear legs 5, 6 comprises an upper tubular section 17 within which is slidably inserted a lower section 18 enabling the length of the legs to be adjusted. The upper section contains a series of holes 19 enabling a locking pin 20 to be inserted through any one of the holes and through a corresponding hole (not shown) in the lower section to fix the leg at a particular length. The length of the legs can thus be independently adjusted on either side of a nominal position in which the truss is inclined at the desired 45 degree angle with the staging on level ground. FIG. 3 shows the legs at their minimum length and FIG. 2 shows them in an extended position. At their lower ends the legs are pivoted to the brace 9 by a releasable connection 21. The tie rod 11 is similarly releasably pivoted to the brace 9, but is non-releasably pivoted at 22 to the lower end of the respective truss 3 or 4 such that the rod can be stowed beneath the truss held by a clip 23.

Figure 4:
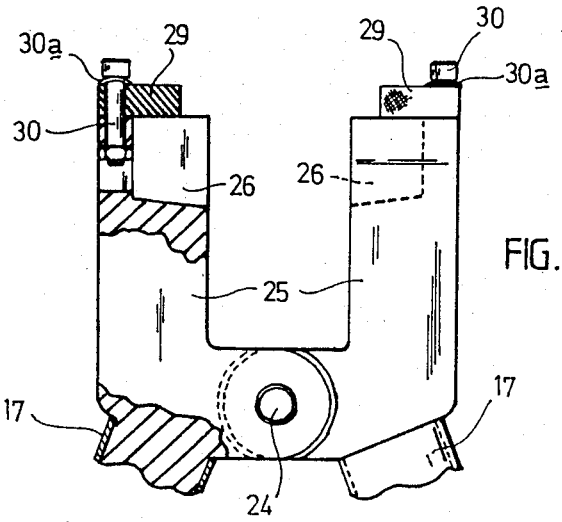
FIG. 4 is an enlarged, partly cross-sectional front view of the upper portion of the leg assembly.

Towards their upper ends each pair of rear legs are secured to a pair of L-shaped members 25 which are pivoted together at 24 FIGS. 3 and 4) to form a U-shaped head. The inner faces of the L-members are provided with opposed upwardly open sockets 26. A pin 27 which is received in a hole 28 in the respective truss (see below) can therefore be dropped into the opposed sockets and retained therein by catches 29 which are pivotally mounted on the upper faces of the jaws 25 by nut and bolt fasteners 30 carrying dish washers 30*a*.

The trusses 3, 4 and legs 5 and 6 all have part-spherical feet 80 (FIG. 2) which in use are swivellably seated in a socket formed by a hole 81 in the corresponding ground plate 13. Thus, on uneven ground the ground plates can be inclined at different attitudes but the feet will still firmly seat within the sockets 81. The plates 13 are provided with upstanding wire loop handles 82 at one edge by which the plates can be slid under the feet 80.

It will be noted from the side view of FIG. 2 that the decking members 15 are arranged in a step configuration, each member being higher than the one immediately in front. Furthermore, the vertical rise between the upper surfaces of the decking members is substantially equal to their width (front to rear distance). It will also be noted that the rear edge of one decking member does not overlap the front edge of the decking member immediately above it. This allows an upstanding photographic baffle to be attached to the rear edge of each decking member without running foul of the decking member immediately above.

Figure 5:
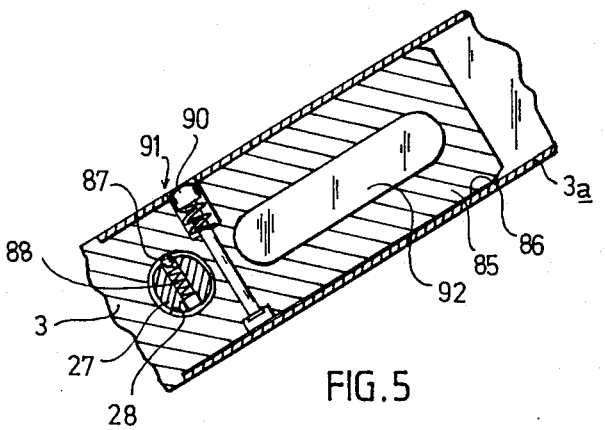
FIG. 5 is an enlarged detailed cross sectional view of the connection between one of the trusses and the upper extension section.

In FIGS. 1 and 2 the basic four deck staging section thus far described has been extended upwardly to convert it into a six deck section. The trusses 3, 4 are provided with axial spigots 85 (see FIG. 2 and detail of FIG. 5) to receive box-section truss extension pieces 3*a*, 4*a*. These extension pieces have open lower ends forming sockets 86 to receive the spigots 85. The holes 28 that receive the pins 27 are formed in the lower ends of these spigots 85. The pins 27 have ball catches 87 which are loaded by compression springs 88 to locate in cooperating grooves inside the holes 28, thereby retaining the pins within the holes. The lower ends of the extension pieces are notched at 89 (FIG. 2) to receive the pins 27. The spigots 85 also contain spring loaded plungers 90, the outer ends of which locate in corresponding holes 91 in the sockets 86 to retain the extension pieces on the spigots. Although the spigots are formed of a solid block of alloy for strength they each have a slot-shaped cutout 92 to reduce their weight.

The upper front faces of the truss extension pieces 3*a*, 4*a* each carry two further V-brackets 14*a*, 14*b* and 14*c*, 14*d* respectively, (FIG. 1) for supporting two further decking members 15*a*, 15*b*. As shown in FIG. 2, at their upper ends the extension pieces 3*a*, 4*a* may have internal apertured plates 95 so that a post 96 can be inserted through the open end of the extension piece, through plate 95 and through a corresponding aperture 97 in the lower rear face of the extension piece. These posts support one or more transverse rear guard rails 98.

Figure 6:
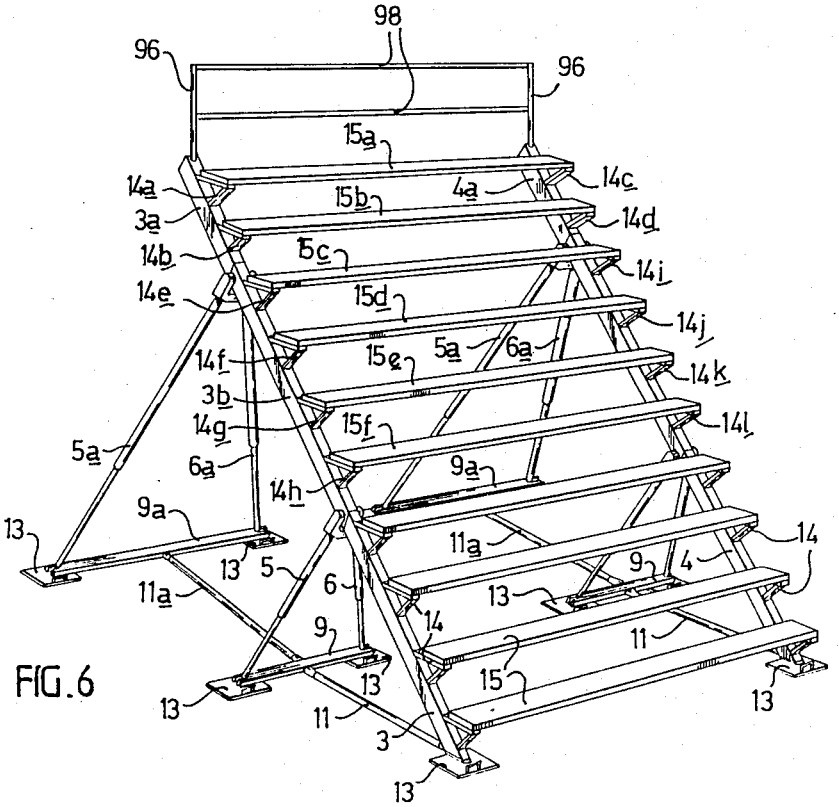
FIG. 6 is a perspective view of the basic four deck section with an upper four deck extension section added.

FIG. 6 shows how the basic four row section can be extended by a further four rows and the two row extension section added to make a total of ten rows. The four row extension section also comprises a pair of truss extension pieces 3*b*, 4*b*, again provided with sockets at their lower ends to receive the spigots 85. However, these extension pieces also carry similar spigots (not shown) at their upper ends to which further extension pieces can be added. Extension pieces 3*b*, 4*b* each carry four V-brackets 14*e–h* and 14*i–l* respectively to which the four additional decking members 15*c–f* can be secured. An additional pair of rear legs 5*a*, 6*a* is added to the upper end of each extension piece 3*b*, 4*b* in the manner previously described in relation to legs 5, 6. These additional rear legs are of the same basic structure as legs 5, 6 except that they are of course longer. They are again seated on ground plates 13 and each pair of legs is bridged at their lower ends by a removable brace 9*a*. A tie rod 11*a* releasably connects the mid point of the brace 9*a* to the mid point of brace 9. The two row extension section of FIGS. 1 and 2 is added to this four row extension, as shown. Further four row extension sections could also be added as required, in similar manner. The various sections could of course carry decking members other than the number specified. For example, the basic section could have say three or five rows, and the intermediate extension sections could have say two, three or five rows. The uppermost, unsupported extension section could have from one to three rows.

Figure 7:
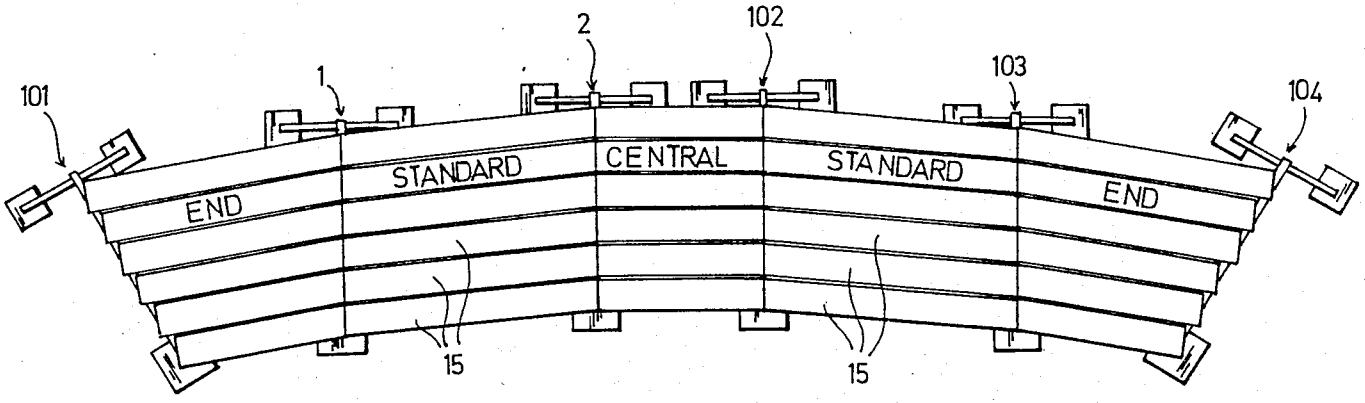
FIG. 7 is a top plan view illustrating how the single staging section can be extended horizontally.

As will shortly be described, each decking member is flexibly connected to the respective truss or extension piece for pivotal movement in both vertical and horizontal planes. This ensures that the staging will stand firmly on the ground even if the two support assemblies are inclined at slightly different attitudes. In addition, the basic four row staging section, together with any upper extension sections, can be extended laterally as shown in FIG. 7. Further decking members are added to each of the support assemblies 1, 2 and these are connected to further support assemblies 101–104 of the kind described. In the case of photographic staging in particular, it will often be desirable to curve the staging into an arc as illustrated in FIG. 7. It will be noted that the central decking members added between support assemblies 2 and 102 are shorter than the rest. A further staging section comprising support assembly 103 is then added to this central section having standard length decking members. The articulation of the decking members in the horizontal plane permits support assemblies 1 and 103 to be set forward relative to support assemblies 2 and 102, as shown, to form an arc. Although further standard sections could also be added to extend the arc in similar manner, it is preferred to use special end sections. These comprise standard support assemblies 101 and 104 but have decking members which progressively decrease in length towards the front of the staging as shown. The end support assemblies 101 and 104 are thereby radially angled towards the camera to produce the correct visual effect.

Figure 8:
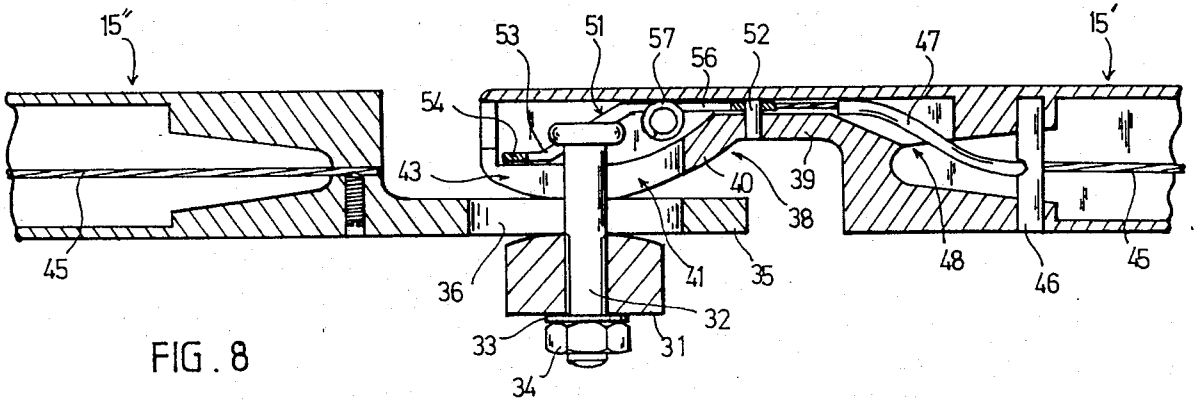
FIG. 8 is an enlarged detailed cross sectional view of the connection between a support bracket of one of the intermediate trusses and two decking members which extend on either side thereof.
Figure 9:
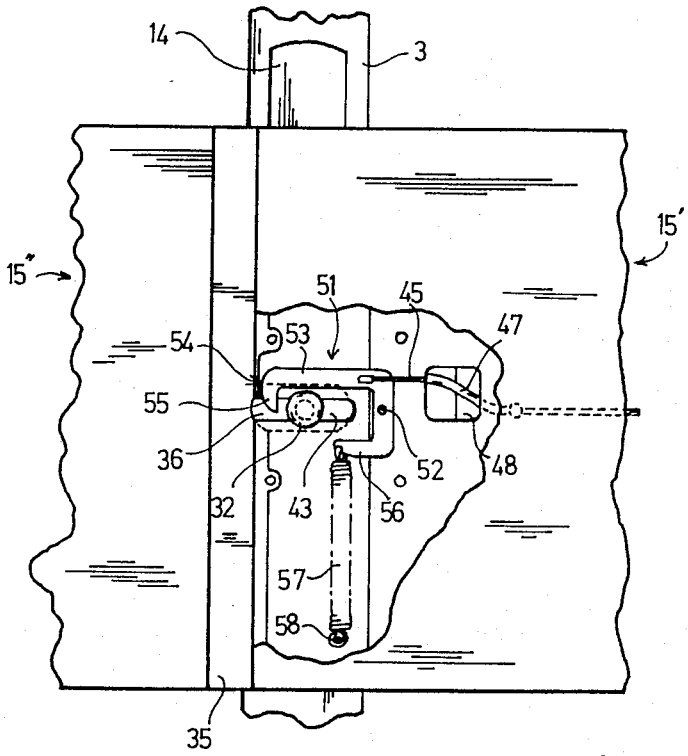
FIG. 9 is a cut-away top plan view of the connection of FIG. 8.

One way in which the decking members can be connected to the trusses will now be described in detail with reference to FIGS. 8 and 9. A horizontal upper limb 31 of each V-bracket 14 carries an upstanding headed pin 32 about half way along its length. The pin is screw threaded into the limb 31 and is held by a washer 33 and lock nut 34 threaded onto its lower end. At one end, each standard decking member 15″ has a stepped upper surface to form a tongue 35 of lesser thickness than the main portion of the decking member. This tongue contains a longitudinally extending closed slot 36 to drop over the pin 32. It will be noted that the upper surface of the limb 31 has a convex curvature in transverse section to accommodate angular movement of the decking member in a vertical plane relative to the bracket 14. The decking member is also free to move angularly in a horizontal plane about the pin 32.

The opposite end of each standard decking member 15′ has a cranked end portion 38 providing a stepped undersurface such that the end of decking member 15′ can overlap the opposite end of decking member 15″ with their upper faces lying on a common plane. More specifically, the end portion 38 comprises a flat portion 39 extending from the main body of the decking member and leading into a downwardly inclined portion 40 which in turn leads into a further generally horizontal portion 41. A longitudinal slot 43 is formed in the lower portion 41 and is open at one end to receive the stem of pin 32. However, the decking member cannot lift off the pin because the head is unable to pass through the slot. The lower face of portion 41 is convexly curved so that decking member 15′ is also able to move angularly in both a vertical and a horizontal plane about the pin 32 independently of decking member 15″.

Each decking member is hollow and has a steel cable 45 running longitudinally within it. One end of the cable is anchored adjacent to flange 35 whereas the opposite end passes through a guide pillar 46 and travels within a sheath 47 through an aperture 48 until it lies above the cranked portion 38. As can be seen in FIG. 9, a catch 51 formed of a G-shaped stamping is mounted horizontally above the cranked portion 38 and is pivoted to the upper portion 39 at 52. The cable 45 is anchored to a longer limb 53 of the stamping which extends longitudinally to one side of the pivot 52. As shown in FIG. 8, this limb is cranked in a vertical plane such that a nose portion 54 having a rounded outer edge 55 intervenes between the pin 32 and the open end of slot 43. A further, shorter limb 56 of the stamping extends longitudinally at the opposite side of the pin 32 and is connected to a tension spring 57 which is anchored at 58 to inclined portion 40. Thus, the spring 57 urges the catch into such a position that the nose 54 prevents the pin 32 from leaving the slot 43, but by pulling the cable 45 the catch can be pivoted in a clockwise direction (as viewed in FIG. 9) so that the nose no longer holds the pin captive. On the other hand, the rounded edge 55 of the nose allows the pin to be inserted into the slot by displacing the catch against the action of spring 57.

Figure 10:
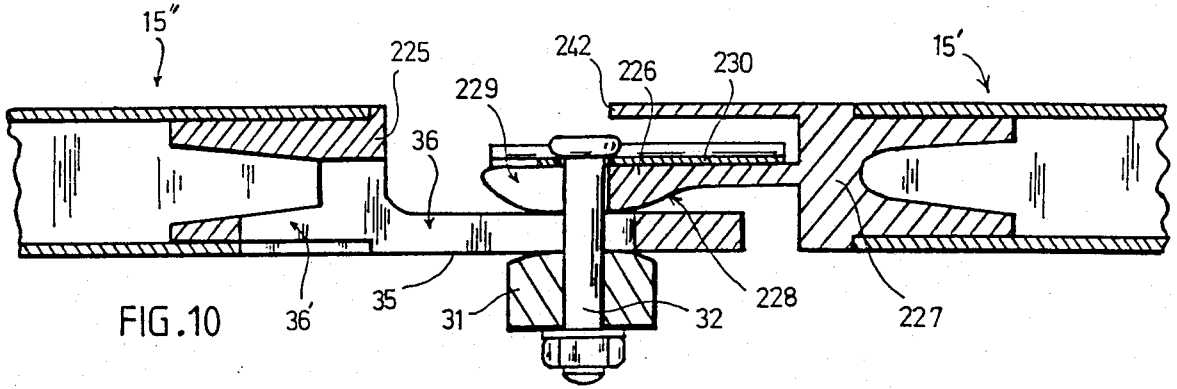
FIG. 10 is a view similar to FIG. 8 of another possible form of connection between two adjacent decking members and their associated support bracket.
Figure 11:
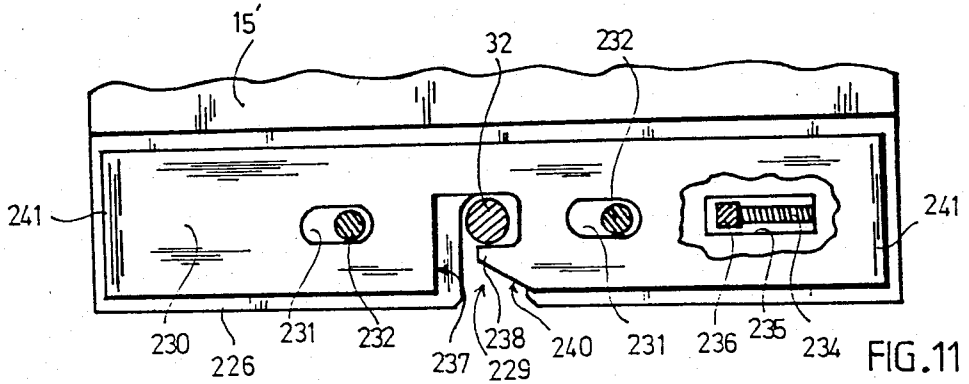
FIG. 11 is a top plan view of part of the connection of FIG. 10.

FIGS. 10 and 11 show an alternative, somewhat simplified connection between two decking members and the bracket 14. The left hand decking member 15″ again has a projecting tongue 35 at one end containing a longitudinally extending slot 36 to receive the pin 32. However, this slot is extended through the end wall 225 of the decking member at 36′. The other decking member 15′ has a further tongue 226 which projects from the mid-thickness of its end wall 227 to overlap with tongue 35. The upper surface of this tongue is flat but the undersurface 228 is convexly curved longitudinally of the deck to permit independent vertical pivotal movement of both decking members. The decking members can also pivot independently about the pin 32 in the horizontal plane. The tongue 226 contains a longitudinal slot 229 which is open at the free end of the tongue to receive pin 32, but it is too narrow for the head of the pin to pass through. A catch plate 230 is mounted on the upper surface of the tongue 226 and this will now be described in detail.

The plate 230 contains two spaced slots 231 disposed transversely of the deck through which a respective headed bolt 232 is inserted into the tongue 226 to secure the plate in place but at the same time permit sliding movement of the plate transversely of the deck. The plate is urged to the left by a compression spring 234 located in a transverse slot 235 in tongue 226, bearing againt the right hand end of the slot and against an abutment 236 rigid with plate 230. The plate has a cutout 237 which lies above slot 229 and comprises a nose 238 which locates behind the pin. However, the outer edge 240 of the nose is inclined so that as the pin 32 enters the slot the plate is urged to the right. The plate then returns under the action of spring 234 to prevent the pin 32 from leaving the slot 229. To disconnect the deck from the bracket 14 the plate is slid to the right, the ends of the plate being upturned at 241 for gripping. The deck can then be slid off the pin, and since each standard deck has a tongue 35 at its opposite end the elongated slot 36 enables the deck to be removed in one smooth sliding and lifting action.

The fishplate 242 projecting from the end of deck 15′ above plate 230 protects the catch plate from being trodden on.

Figure 12:
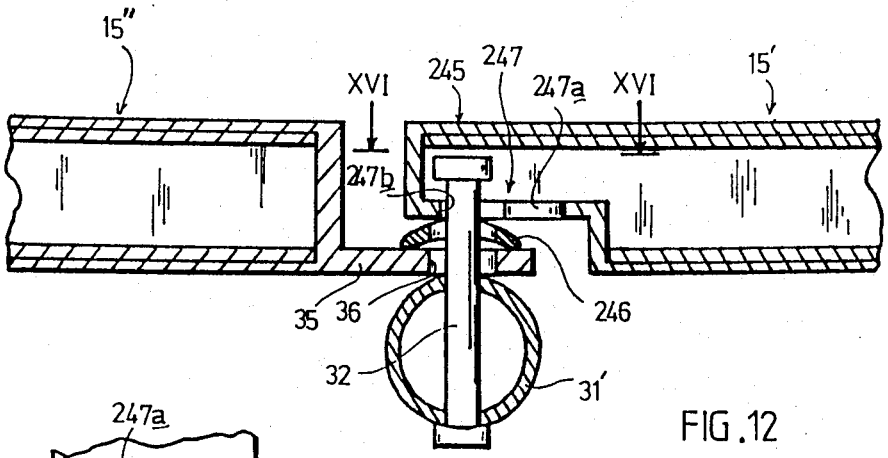
FIG. 12 is a longitudinal cross-sectional view through a further possible form of connection between two adjacent decking members and their associated support bracket.
Figure 13:
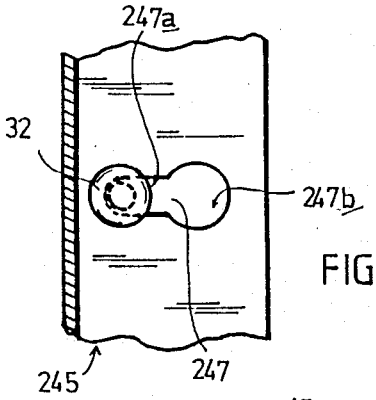
FIG. 13 is a top plan view partly in cross-section of part of the connection of FIG. 12.

The coupling arrangement of FIGS. 12 and 13 is even more simplified and has been developed specifically for use with smaller staging. Here, the horizontal upper limb of the decking support bracket is shown as a round tube 14′ which carries pin 32. Decking member 15″ again has a projecting tongue 35 at one end containing an aperture 36 to receive the pin 32. The other decking member 15′ has a hollow tongue 245 which projects from the upper edge of the deck to overlap with tongue 35. An elongate spacer 246 of curved section is located on the pin 32 between the overlapping tongues 35 and 245 to aid the independent vertical pivotal movement of both decking members. The decking members can also pivot independently about the pin 32 in the horizontal plane. The lower wall of tongue 245 contains a keyhole shaped slot 247 comprising a first portion 247*a* through which the head of the pin 32 can pass, and a narrower portion 247*b* into which the stem of the pin can pass but not the head. This second portion extends towards the free end of the tongue 245. Thus, after dropping the decking member onto the pin the decking member is locked thereto by sliding the decking member to the right so that the stem of the pin enters the narrower portion of the aperture 247*b*. Alternatively the entire truss assembly can be pulled slightly to the left as shown. In the case of curved staging the movement of the support assemblies towards the curved position will automatically cause the pin to enter the narrower portion of the aperture. The decking members are removed by the reverse process.

In addition to being of shorter length, the decking members of the central staging section shown in FIG. 7 also differ from the standard members in that they each have a lower tongue 35 at both ends.

Figure 14:
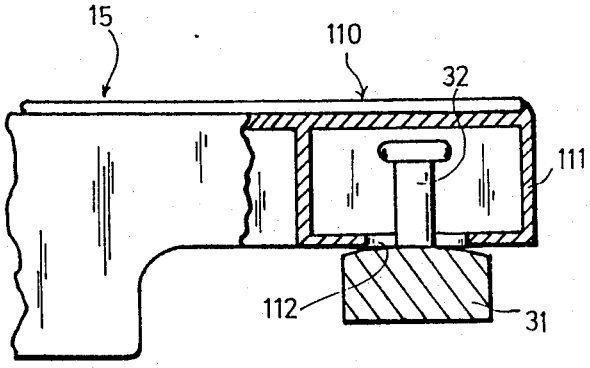
FIGS. 14, 15 and 16 show details of the connection between an end truss and a decking member, in longitudinal vertical, longitudinal horizontal and transverse cross section respectively.
Figure 16:
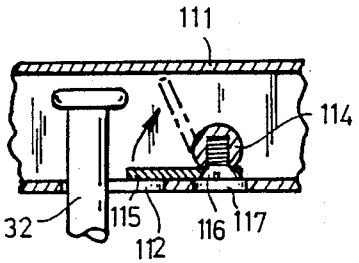
Figure 15:
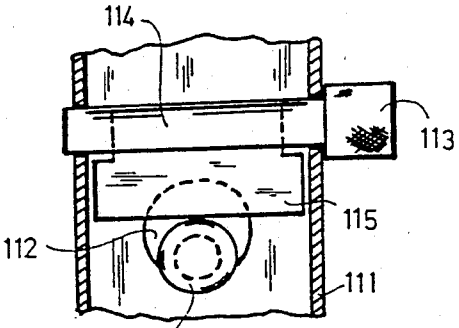

FIGS. 14 to 16 show how the end decking members can be connected to the outermost support assemblies 101, 104. The support brackets 14 are again provided with headed pins 32 but the lower portion of the end decking member 15 is stepped at its end to form an upper tongue 110.

This terminates in a transverse box member 111 which contains a hole 112 in its lower face to receive the pin 32. Thus, the decking member is again capable of articulation in a vertical and a horizontal plane. As shown in FIGS. 15 and 16, a knob 113 is secured to a spindle 114 which extends in a freely rotatable manner through the box member 111 adjacent to the hole 112. The underside of the spindle has a flat to which is secured a catch plate 115 by screws 116. When the decking member is lowered onto the pin 32 the head of the pin lifts the plate and freely enters the hole 112, a slot 117 in the lower wall of box member 111 ensuring that the plate 115 clears that wall. The plate thereafter returns under its own weight to a horizontal position in which it partially overlies the hole 112 and prevents the head of the pin from leaving the hole. When it is required to dismantle the staging the plate is rotated by the knob 113 to the position shown in broken outline in FIG. 16 and the pin is thus free to leave the hole 112.

Figure 17:
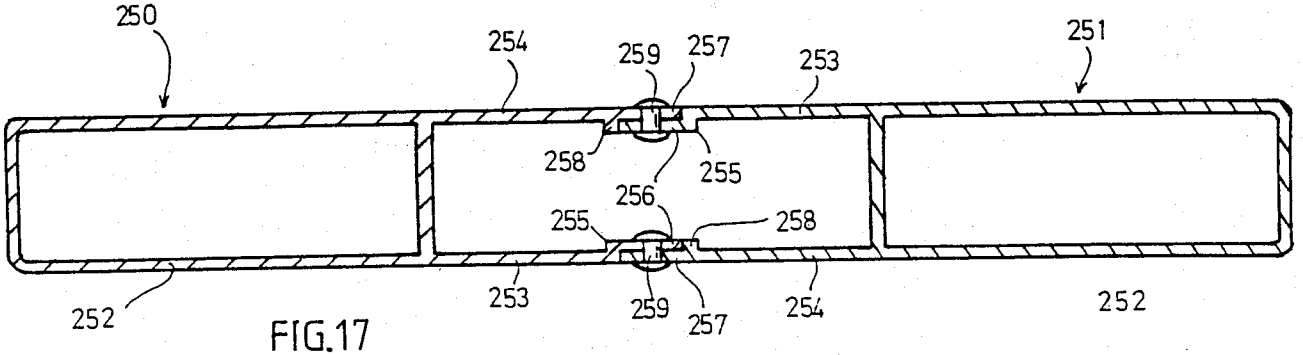
FIG. 17 is a cross-sectional view through a decking member for use in the staging.

The decking members may be lightweight metal extrusions. FIG. 17 shows how a decking member can be formed of two identical extruded lengths 250, 251. Each extrusion comprises a rectangular box portion 252, the two wider faces of which are extended to one side forming a pair of parallel arms 253, 254. The outer edge of one arm 253 is stepped inwardly at 255 forming a flange portion 256. This flange overlaps with the edge 257 of the other arm and abuts a rib 258 provided on its inner surface. The pairs of overlapping edge portions 256, 257 are fastened together by rivets 259.

Figure 18:
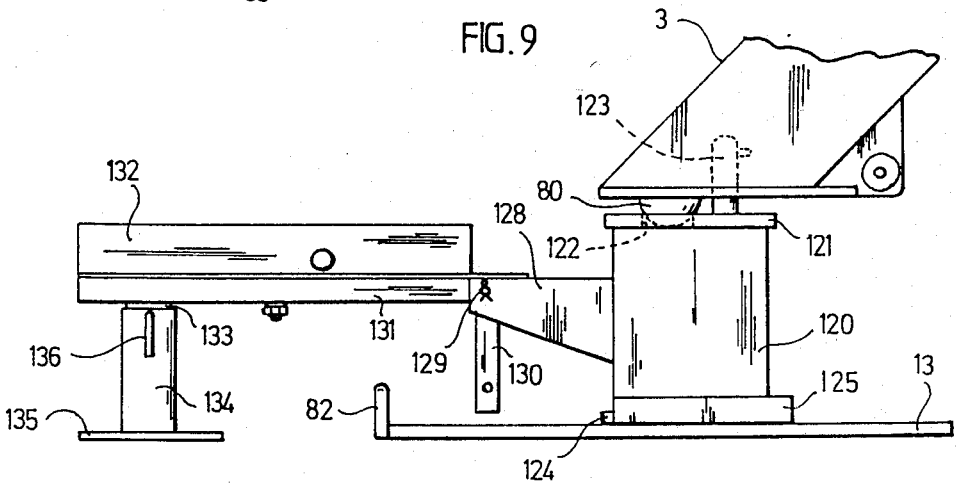
FIG. 18 is an end elevational view of an assembly for adding an additional lower decking member to the staging.

FIG. 18 shows how an additional lower decking member that can be provided for each staging section. Each truss is associated with an upstanding pedestal 120 which carries a top plate 121 having a hole 122 to receive the foot 80 of the truss. A locating peg 123 enters a corresponding hole in the lower end of the truss. The pedestal is mounted on a base plate 124 which is slidably received between inverted-L shaped guides 125 mounted on a ground plate 13. The ground plate again has an upstanding handle 82 at one edge. The front of the pedestal carries lugs 128 which are pivotally connected at 129 to a depending limb 130 of a support member 131 for a further decking member 132. The front of support member 131 has a depending spigot 133 which is received within a tubular leg 134 upstanding from a respective foot plate 135. A locking pin 136 can be inserted through leg 134 and spigot 133 to determine the distance between the foot plate 135 and decking member 132. Spigot 133 and limb 130 both have vertically spaced holes providing a choice of heights for the decking member. The additional decking member 132 is pivotally connected to support member 131 by a similar arrangement to that described above for decking members 15. The pivotal connection 129 ensures that the decking member 132 remains stable on uneven ground.

All the major structural components of the staging are of aluminum alloy to reduce its weight to a minimum.

The staging may be assembled by opening each pair of rear legs flat on the ground and connecting the braces 9. Each truss is then laid on the ground with its top portion between the feet of the respective legs, and the tie rods 11 are connected to the braces 9. The top end of each truss is than lifted, the rear legs are raised to an upright position, and the pin 27 is dropped into the sockets 26. The tripod arrangement of each truss and its associated support legs ensures that the truss assembly will always stand firmly on uneven ground such as a sports field for example. If required the rear legs can be adjusted in length to bring the respective truss to the required inclination, the pivotal connections 21 between the legs 5, 6 and the braces 9 and the pivotal connection 24 at the upper ends of the legs enabling this adjustment to take place. It will be noted that the holes 19 only permit relatively coarse adjustment but this is of no real consequence because of the flexible coupling between the decking members and the trusses already described. In fact adjustment of the legs may only be essential on extremely uneven ground as small undulations can easily be accommodated by the deck joints. The decking members are then connected to the trusses as described.

If the two row extension illustrated in FIGS. 1 and 2 is to be added the additional truss extension pieces *3a, 4a* are dropped onto the spigots 85 either by climbing up the existing decking or simply from standing on the ground. The additional decking members can then be carried up the decking members of the lower section for attachment. The rear guard rail assembly is then dropped into position by access from the decking.

If a four row extension is to be added instead of the two row section the additional rear legs *5a, 6a* are first attached in a similar manner to that in which the legs of the base section are added. After attachment of their respective brace *9a* to the respective tie rod *11a*, which is in turn connected to the brace 9 of the bottom section, the additional leg assembly is raised to an upright position and connected to the respective truss extension piece *3b, 4b*. This is followed by attachment of the additional decking members which are carried up the decking members of the lower section.

The two row extension section can be added to the four row extension section, as described above. Any additional extension sections are added in similar manner.

The staging can be dismantled by a reverse procedure. With the upper decking members removed the extension pieces can be slid off the trusses and the remaining decking members removed. The trusses can then be lifted out of the sockets 26 and the trusses and the rear legs lowered to the ground. The tie rods 11 are then disconnected from the braces 9 and stowed beneath the trusses. The braces are then removed allowing the rear legs to be pivoted together.

It will thus be seen that the staging is quick and simple to assemble and dismantle, and the ability to extend the staging sections upwardly by climbing up the lower sections is a great advantage. The staging is easily transportable in its dismantled state, and indeed, the staging is designed so that all of the components will fit into a standard estate car.

The tie rods 11 could be replaced by flexible elements such as chains.

I claim:

1. Staging comprising:

a pair of mutually spaced support assemblies, each support assembly comprising, a truss member having front and rear ends, a pair of legs arranged in an inverted V configuration to support said truss member with a rearward inclination, upwardly, first connection means positively connecting said pair of legs to said truss member to prevent movement of said legs longitudinally of said truss member, bracing means joining said pair of legs, and tie means joining said bracing means to said front end of said truss member;

a plurality of decking members bridging said truss members of said support assemblies in a stepped configuration; and second connection means pivotally connecting said decking members to each truss member to permit pivotal movement of each decking member with respect to each truss member in a substantially vertical plane disposed longitudinally of each decking member so that said support assemblies are able to adopt mutually different attitudes.

2. Staging as claimed in claim 1 wherein:

each decking member is supported by a substantially horizontal limb of a support bracket secured to a respective truss member.

3. Staging as claimed in claim 2 wherein:

said horizontal limb has an upper surface which is convexly curved in a direction transverse to the longitudinal direction of the associated truss member.

4. Staging as claimed in claim 2 wherein:

said second connection means comprises a headed pin upstanding from said horizontal limb of each support bracket; and further comprising aperture means in each respective decking member for receiving said headed pin.

5. Staging as claimed in claim 4 wherein:

said aperture means comprises an open ended slot having a width less than the head of said pin for preventing said head from passing therethrough.

6. Staging as claimed in claim 5 wherein:

a catch member is provided on each decking member having a retaining portion which is locatable behind said pin between said pin and said open end of said slot to hold said pin captive in said slot; and said catch member is movable into a released position in which said pin is free to leave said slot unimpeded by said catch member.

7. Staging as claimed in claim 6 wherein:

said catch member is resiliently biassed into the captive position by a biassing means.

8. Staging as claimed in claim 7 wherein:

said retaining portion of said catch member comprises an inclined outer edge engageable by said pin as said pin enters said slot so that said catch member is automatically urged towards said released position by the pin against the action of said biassing means allowing the pin to enter the slot.

9. Staging as claimed in claim 8 wherein:

said catch member is slidable transversely relative to said decking member.

10. Staging as claimed in claim 8 wherein:

said catch member is pivotable about an axis substantially normal to said decking member.

11. Staging as claimed in claim 10 and further comprising:

a pull cable secured to said catch member at a position offset from said pivot axis so that pulling said cable rotates said catch member towards said released position.

12. Staging as claimed in claim 4 wherein:

said aperture means comprises communicating first and second pin-receiving portions having relative sizes so that the head of said pin can pass through said first portion but not through said second portion.

13. Staging as claimed in claim 12 wherein:

said second portion extends from said first portion towards the adjacent end of said decking member.

14. Staging as claimed in claim 4 wherein:

said aperture means is provided in a tongue extending from the end of a respective decking member.

15. Staging as claimed in claim 14 wherein:

said tongue has an underside curved longitudinally of said decking member.

16. Staging as claimed in claim 4 wherein:

a catch member is provided on said decking member and is locatable beneath the head of said pin when said pin is inserted into said aperture means thereby preventing said pin from leaving said aperture means; and means are provided for moving said catch member out of engagement with the head of said pin.

17. Staging as claimed in claim 1 wherein:

each second connection means provides for pivotal movement of a respective decking member in a substantially horizontal plane.

18. Staging as claimed in claim 1 wherein:

said second connection means releasably connects said decking members to said truss members.

19. Staging as claimed in claim 1 wherein:

said legs of said support assemblies and the front ends of said truss members are supported on respective swivellable ground plates.

20. Staging as claimed in claim 19 wherein:

said legs and truss members have part-spherical feet swivellably seated in corresponding recesses in upper surfaces of respective ground plates.

21. Staging as claimed in claim 1 and further comprising:

a further said support assembly a plurality of additional decking members bridging the truss member of said further support assembly with a common truss member comprised of one of said truss members of said pair of support assemblies; and an end on each additional decking member connected with an end of one of said first mentioned decking members;

the connected ends of said decking members being supported by said common truss member, said additional decking members being pivotally connected to both of their supporting truss members by said second connection means.

22. Staging as claimed in claim 21 wherein:

each decking member is supported by a substantially horizontal limb of a support bracket secured to a respective truss member;

said second connection means comprises a headed pin upstanding from said horizontal limb of each support bracket;

aperture means is provided in each respective decking member for receiving said headed pin;

each further decking member has a tongue extending from the connected end thereof; and an aperture is provided in said tongue for receiving a respective pin on said common truss member, said tongue being located between a respective support bracket and a tongue on a respective first mentioned decking member.

23. Staging as claimed in claim 1 wherein:

said first connection means comprises upper ends on each pair of legs connected to a U-shaped head which is coupled to a respective truss member by a pin inserted through said truss member.

24. Staging as claimed in claim 23 wherein said U-shaped head comprises:

two L-shaped portions each rigidly connected with a respective leg; and lower limbs on each L shaped portion pivoted together.

25. Staging as claimed in claim 23 wherein:

said L-shaped portions each have an upstanding limb;

upwardly open sockets are provided in said upstanding limbs ; and catch means are provided for retaining said pin in said sockets.

26. Staging as claimed in claim 1 for supporting a standing group of people wherein:

said truss members have inclinations of greater than 30 degrees to horizontal.

27. Staging as claimed in claim 26 wherein:

said truss members are inclined at greater than 40 degrees to horizontal.

28. Staging as claimed in claim 27 wherein:

said truss members are inclined at 42 to 47 degrees to horizontal.

29. Staging as claimed in claim 1 and further comprising:

a pedestal for location beneath said front end of each truss member; and a further decking member supported on said pedestal.

30. Staging as claimed in claim 29 wherein:

said further decking member has a rear edge and a front edge;

said rear edge of the further decking member is supported on said pedestal; and a front leg is provided for supporting said front edge of said further decking member.

31. Staging as claimed in claim 30 wherein:

said further decking member is pivotally coupled to said pedestal.

32. Staging as claimed in claim 30 wherein:

the height of said further decking member is adjustable relative to said front support leg and said pedestal.

33. Staging as claimed in claim 1 wherein:

each truss member comprises a plurality of interconnectable sections, and all the corresponding sections of the truss members are bridged by at least one decking member.

34. Staging as claimed in claim 33 wherein:

one of said truss member sections is provided with an axial spigot; and an aligned socket is provided at an end of another interconnectable truss member section for receiving said axial spigot therein.

35. Staging as claimed in claim 34 wherein:

said truss member sections comprise box shaped sections; and said socket is formed by an open end of a respective truss member section.

36. Staging as claimed in claim 1 wherein:

each decking member comprises a pair of adjacent metal extrusions connected together by a longitudinal joint.

37. Staging as claimed in claim 36 wherein:

each extrusion comprises an enclosed hollow box section.

38. Staging as claimed in claim 37 wherein:

each extruded section comprises a rectangular box section having the longer faces thereof extended to one side to form edge portions; and one of the extended sides is provided with an inwardly stepped edge portion overlapping the edge portion of the adjacent section.

39. Staging as claimed in claim 38 wherein:

said sections are joined by fastening elements inserted through said overlapping edge portions of the extended sides.

40. Staging comprising:

a pair of mutually spaced support assemblies, each support assembly comprising, a truss member having front and rear ends, a pair of legs arranged in an inverted V configuration to support said truss member with a rearward inclination upwardly, said legs having upper and lower ends, said upper ends of said legs being pivotally coupled together, means between said upper and lower ends of at least one of said legs for adjusting the length thereof, connection means for positively connecting said pair of legs to said truss member to prevent movement of said legs longitudinally of said truss member, bracing means pivotally coupled to and joining said pair of legs adjacent to said lower ends thereof, and tie means joining said bracing means to said front end of said truss member; and a plurality of decking members bridging said truss members of said support assemblies in a stepped configuration.

41. Staging as claimed in claim 40 wherein:

said adjusting means is provided on both legs of each pair of legs.

* * * * *